United States Patent [19]

Isherwood et al.

[11] 4,452,140

[45] Jun. 5, 1984

[54] PRINTED WEB REGISTRATION CONTROL APPARATUS

[75] Inventors: Jeffrey Isherwood, Enfield; Delwyn L. Morris, Potters Bar, both of England

[73] Assignee: Crosfield Electronics Limited, London, England

[21] Appl. No.: 347,857

[22] Filed: Feb. 11, 1982

[30] Foreign Application Priority Data

Feb. 19, 1981 [GB] United Kingdom ..... 8105325

[51] Int. Cl.[3] ..... B41F 5/06; B41F 5/16

[52] U.S. Cl. ..... 101/181; 101/248

[58] Field of Search ..... 101/181, 248; 226/24, 226/28, 29, 42, 2

[56] References Cited

U.S. PATENT DOCUMENTS

| | | | |
|---|---|---|---|
| 3,102,471 | 9/1963 | Auer et al. | 101/181 |
| 3,120,181 | 2/1964 | Thiede | 101/181 |
| 3,165,056 | 1/1965 | Heatley, Jr. et al. | 101/181 |
| 3,264,983 | 8/1966 | Lewis et al. | 101/181 |
| 3,329,087 | 7/1967 | Sandor et al. | 101/181 |
| 3,915,090 | 10/1975 | Horst et al. | 101/181 |

*Primary Examiner*—J. Reed Fisher

*Attorney, Agent, or Firm*—Sughrue, Mion, Zinn, Macpeak and Seas

[57] ABSTRACT

An apparatus for controlling the registration between a printed web of material and a downstream processing station comprising a control unit which further controls a web path register to change the web path length as a function of the output of a print detector monitoring the passage of said web and as a function of an encoder coupled to a web processing station to provide an output signal indicative of the operation of the web processing station wherein said apparatus compensates for error resulting in the registration of the printing on the web due to variations in the printed repeated length of the web extending between both (1) the printing station and the print detector and (2) the print detector and a subsequent web processing station.

7 Claims, 3 Drawing Figures

PRINTED WEB REGISTRATION CONTROL APPARATUS

Figure 1:
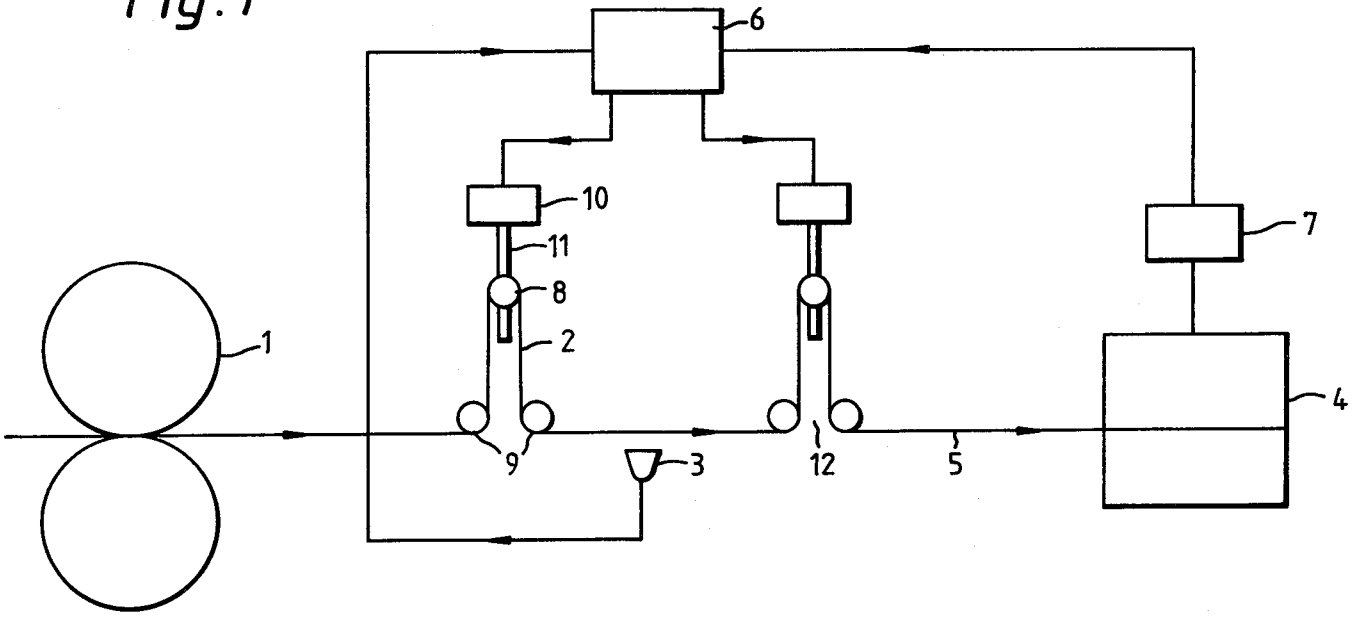

It is necessary to control the registration between a printed web of material and a downstream web processing station at which the printed web is, for example, cut, folded, cut and folded, or punched, at a particular location with respect to the printing on the web. The printing station and the web processing station are operated in synchronism, usually by them sharing a common drive. Thus, once they have been initially set up, errors in the registration between the printing on the web and the web processing station result from changes in the conditions or in the physical properties of the web. For example, changes in the tension of the web upstream of the printing station, changes in the pressure exerted at the printing station, and changes in the extensibility of the web all cause the repeat length of the printing on the web to change. Subsequent changes in the shrinkage or extensibility of the web which may be caused by changes in the atmosphere surrounding the web path, or changes in the tension in the web downstream from the printing station cause further changes to occur in the repeat length of the printing on the web. Since these changes result in a change in the repeat length of the printed pattern the total number of repeats of the printed pattern between the printing station and the web processing station varies as a result of these changes. To ensure that the web processing station operates on the web at a particular location with respect to the printing on the web it is therefore necessary to vary the path length of the web extending between the printing station and the web processing station to compensate for the changes that take place in the pattern repeat length.

To provide some compensation for such errors in the length registration of printed web it is normal to include apparatus to control the length register of the printed web. Conventionally, such apparatus comprises a length registration station in the web path between the printing station and the web processing station, a print detector along the web path between the length registration station and the web processing station to monitor the passage of printing on the web, an encoder coupled to the web processing station to provide an output signal indicative of the operation of the web processing station, and a control unit which recieves the output from the print detector and the output signal of the encoder coupled to the web processing station and which provides an error output signal indicative of the difference in phase between the two, the error output signal from the control unit causing the web path length through the length registration station to vary to compensate for any error in the registration of the printing on the web resulting from variations in the printed repeat length in the length of web extending between the printing station and the print detector.

It is not possible to locate the print detector at the operating point of the web processing station and consequently, the print detector is located along the web path in between the length registration station and the web processing station. Typically, it is located one or more printed pattern repeats away from the operating point of the web processing station. Thus, with the print detector mounted upstream from the web processing station the error in the registration of the printing that is derived is the error in registration resulting only from the variations in the printed repeat length in the length of the web extending between the printing station and the print detector. No account whatsoever is taken of the fact that the repeat length of the printing on the web extending between the print detector and the web processing station also varies. Thus, with the conventional apparatus, it is impossible completely to eliminate errors in the length registration of the printed web with respect to the web processing station because the print detector is located upstream from the web processing station.

According to this invention an apparatus for controlling the length register of a printed web of material also includes further registration means operated in dependence upon the output of the control unit to compensate for any error in the registration of the printing on the web resulting from variations in the printed repeat length in the length of web extending between the print detector and the web processing station.

Thus, with the apparatus in accordance with this invention the output error signal which gives an indication of the error that exists in the registration of the printing on the web at the print detector is firstly used to control the length registration station to compensate for any error in the registration of the printing on the web that results from variations in the print repeat length in the length of the web extending between the printing station and the print detector, and secondly this error output signal is used to control the operation of a further registration means to provide compensation of any error in the registration of the printing on the web resulting from variations in the printed repeat length in the length of the web extending between the print detector and the web processing station. Clearly, using this apparatus there is no direct monitoring of the registration error existing at the web processing station and resulting from variations in the printed repeat length in the length of the web extending between the print detector and the web processing station but, instead, it is assumed that the variation in the printed pattern repeat length both upstream and downstream of the print detector are substantially the same and accordingly, a corresponding correction is made in respect of the web downstream of the print detector in accordance with the monitored error in the print registration in the web upstream from the print detector.

The further registration means may be formed by another length registration station located downstream from the print detector. In this case the other length registration station may be coupled to the length registration station upstream from the print detector or be connected directly to the control unit. In both of these cases, the changes in the path length introduced in the two length registration stations is carried out in a ratio of the length of the web extending between the printing station and the print detector to the length of the web extending between the sensor and the web processing station. One way of coupling the two length registration stations together is for them to have a common drive with a gearbox included in between the two stations so that the path length change caused by the two stations is always in the predetermined ratio. Preferably the control unit produces separate error signals for the two length registration stations to cause the path length change in both length registration stations to always be in the predetermined ratio.

Instead the further registration means may be arranged directly or indirectly to change the phase of the output signal from the encoder to compensate for any error in the registration of the printing of the web resulting from variations in the printed repeat length in the length of web extending between the print detector and the web processing station. In this case the further registration means may be a mechanical device such as a differential gear assembly coupled between the encoder and the web processing station with the other input to the differential gear assembly being provided by a motor under the control of the control unit. Thus, rotation of the other input of the differential gear assembly causes a change in phase to occur between the operating point of the web processing station and the encoder. Alternatively, the further registration means may include a variable phase shift circuit which generates a phase shift representing any error in the registration of the printing on the web resulting from variations in the printed repeat length in the length of web extending between the print detector and the web processing station. In this case, the variable phase shift circuit is connected in series between the output from the encoder and the control unit. In both of these cases the expected error in registration of the printing on the web as a result of variations in the printed repeat length of the web extending between the print detector and the web processing station is allowed for by making an apparent change in the phase of the operating point of the web processing station. By making this apparent change in the phase of the operating part of the web processing station the difference in phase between the printing on the web as monitored by the print detector and the signal representing the operating point of the web processing station then represents the total error in the registration of the printing on the web at the web processing station. Thus, the length registration station upstream from the print detector then compensates for the entire error in the registration of the printing on web as a result of changes in the printed pattern repeat length in the length of web extending between the printing station and the web processing station.

Figure 2:
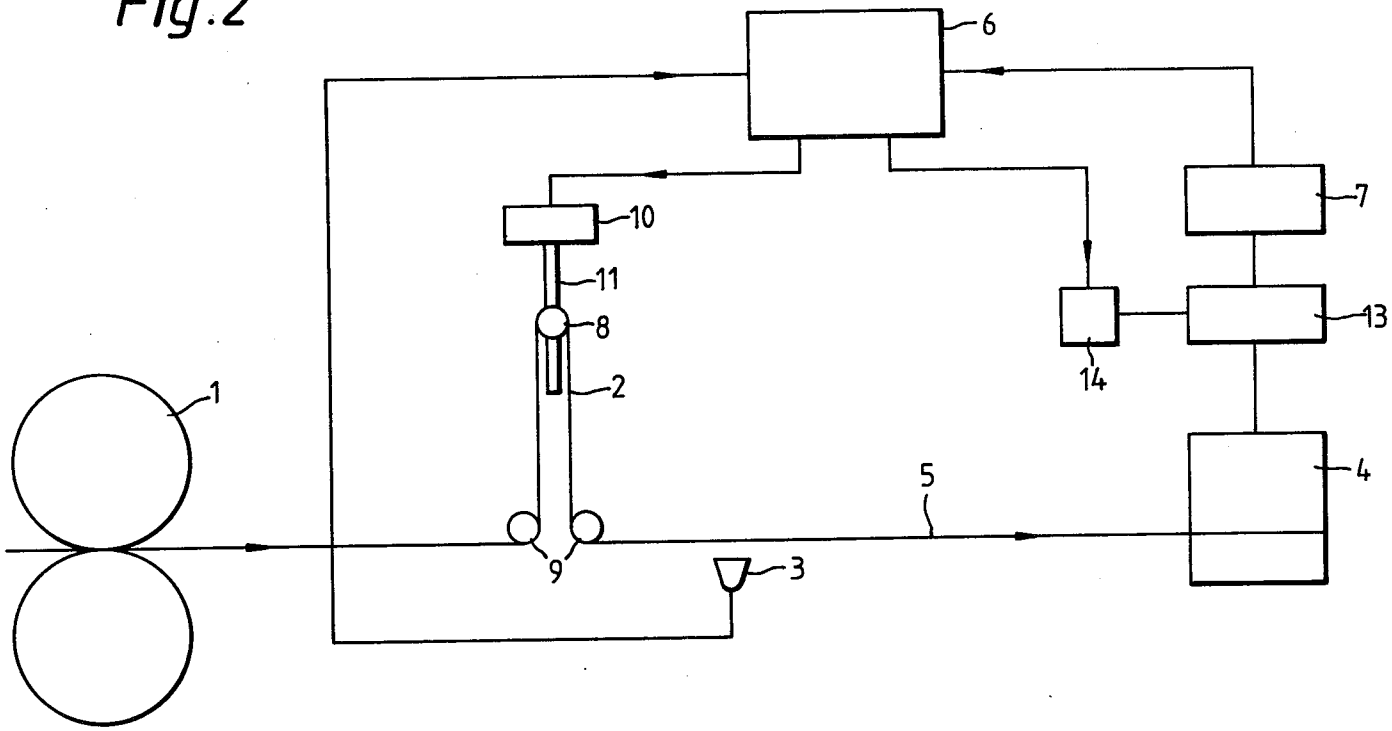
Figure 3:
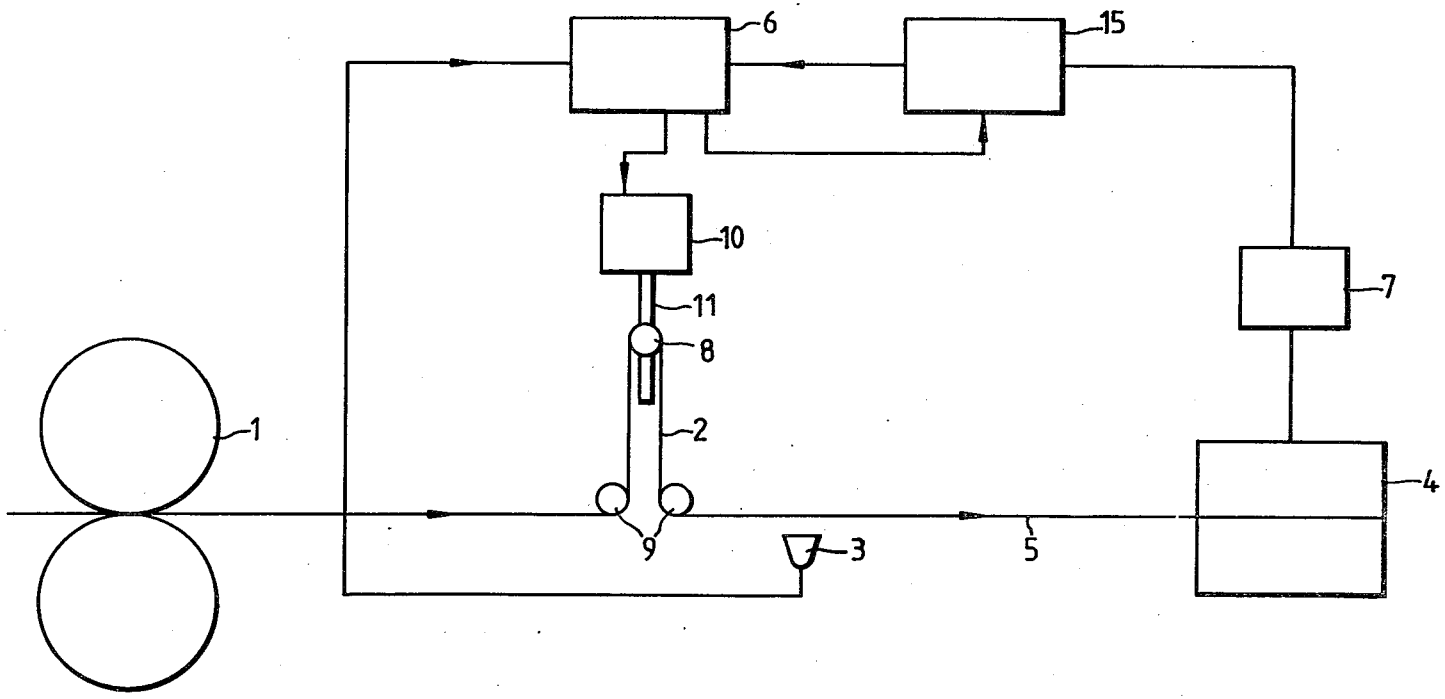

Three particular examples or embodiments of an apparatus in accordance with this invention will now be described with reference to the accompanying drawings, in which:

FIG. 1 shows a diagrammatic representation of the apparatus according to a first embodiment, FIG. 2 shows a similar representations according to a second embodiment, and FIG. 3 shows a similar representation according to a third embodiment.

All three examples of the apparatus comprise a printing station 1, a length registration station 2, a print detector 3, a web processing station 4 all arranged along a web 5 being printed at the printing station 1 and folded and/or cut at the web processing station and a control unit 6 which receives electrical output signals from the print detector 3 and a shaft position encoder 7 connected to the web processing station 4. The shaft position encoder 7 provides an electrical output indicative of the operating point of the web processing station 4.

The length registration station 2 comprises a register or compensator roll 8 movable towards and away from a pair of fixed rolls 9 by operation of synchronous electronic motor 10 and a lead screw 11. When the register roll 8 is moved away from the fixed rolls 9 the web path length through the length registration station 2 increases whereas when the register roller 8 is moved towards the fixed rolls 9 the web path length through the length registration station 2 decreases. The print detector 7 is typically a photoemitter-photodetector pair and the control unit 6 is a standard commercially available controller known by the tradename of Autotron 160 marketed by Crosfield Electronics Limited of London, Great Britain.

In the first example, another length registration station 12 which is identical in construction to the length registration station 2 is included downstream of the print detector 3. With this arrangement if the length of the web from between the nip of the printing station 1 to the web processing station 4 is equal to L, the length of the web between the printing station 1 and the print detector 3 is A, and if the printed pattern on the web is an amount E out of register at the operating position of the web processing station 4, then the error ΔE detected by the print detector sensor 3 is given by:

$$\Delta E = E \times A/L$$

This is clearly less than the error at the operating position of the web processing station 4 by the amount E−ΔE which is equal to $$\Delta E\left(\frac{L-A}{A}\right).$$

Thus, in this first example, the length registration stations 2 and 12 are arranged so that when the roll 8 of the registration station 2 is displaced by an amount Y then the roll 8 of registration station 12 is displaced simultaneously by an amount $$Y \times \frac{L-A}{A}.$$

Thus, assuming that the two registration stations are otherwise identical, this may be achieved by connecting a gearbox with a ratio of $$\frac{L-A}{A}$$

between the drives of the tow registration stations 2 and 12. However it is preferred that an additional output is taken from the control unit 6 and, in this case, one output drives the length registration station 2 to correct the monitored error E whilst the second output drives the length registration station 12 to correct the error $$\Delta E\left(\frac{L-A}{A}\right).$$

Naturally to do this the outputs from the control unit 5 are in the ratio of $$1:\frac{L-A}{A}.$$

For the specific case where the print detector 3 is located halfway along the web path length, naturally the monitored error would be half the total error and this woukld lead to the same compensation taking place in the length registration station 2 as in the length registration station 12 and to the output signal for both stations being identical. Clearly this is a convenient arrangement.

In the second example a differential gearbox assembly 13 and an electric motor 14 is included. The differential gearbox assembly 13 is connected between the web processing station 4 and its position encoder 7. The electric motor 14 is connected to and driven by the control unit 6. In operation, when an output from the control unit 6 moves the register roller 8 in the length registration 2 the electric motor 14 is also operated to move the differential gear assembly 13 to introduce a phase difference between the shaft position encoder 7 and the operating point of the web processing station 4. This change in the apparent position of the operating point of the web processing station 4 changes the relative phase between the output of the print detector 3 and the output of the shaft position encoder 7. The extent of the change in phase introduced by the differential gear assembly 13 is arranged to be equal to the difference between the total error and the error at the print detector 3 and thus equal to $$E\Delta\left(\frac{L-A}{A}\right)$$

This apparent change in phase of the web processing station is fed into the control unit 6 and thus the output from the control unit 6 then represents the total error in the registration of the printing of the web at the operating point of the web processing station 4 and so the output from the control unit 5 causes the register roller 8 in the length registration station 2 to move to a sufficient extent to compensate for the total error.

The third example is generally similar to the second example in that it only includes a single length registration station 2. In the third example a variable phase shift control 15 is connected in series between the output of the position encoder 7 and the control unit 6. The extent of the phase shift introduced by the variable phase shift control 15 must again be sufficient to compensate for the difference between the total error and the error at the print detector 3 and thus be equal to $$\Delta E\left(\frac{L-A}{A}\right).$$

We claim:

1. In an apparaus for controlling the length register of a printed web of material including a printing station for printing a repetitive pattern on a web of material, a length registration station for varying the length of the web path, a print detector, a web processing staion, an encoder coupled to said web processing station, and a control unit, said web of material printed by said printing station following a web path from said printing station through said length registration station past said print detector to said web processing station, said print detector monitoring the passage of printing on said web, and providing a print output signal indicative of said passage of said printing on said web, said encoder coupled to said web processing station providing an operating output signal indicative of the operation of said web processing station, said control unit receiving said print output signal and said operating output signal and providing an error output signal indicative of the difference in phase between said print output signal and said operating output signal, said error output signal from said control unit controlling said length registration station thereby causing said web path length through said length registration station to vary as a function of said error signal whereby any error in the registration of said printing on said web resulting from variations in the repeat length of said repetitive pattern in said length of said web extending between said printing station and said print detector is compensated, the improvement wherein, further registration means to adjust said error signal are coupled to said control unit and are operated in dependence upon the difference in phase between said print output signal and said operating signal in order to compensate further for any error in said registration of said printing on said web resulting from variations in said repeat length of said repetitive pattern in said length of said web extending between said print detector and said web processing station.

2. The apparatus of claim 1, wherein said further registration means is formed by another length registration station located in said web path downstream from said print detector.

3. The apparatus of claim 2, wherein said other length registration station is coupled to said length registration station in said web path upstream from said print detector.

4. The apparatus of claim 2, wherein said other length registration station is connected directly to said control unit.

5. The apparatus of claim 1, wherein said further registration means is arranged to change the phase of said operating output signal to compensate for any error in said registration of said printing on said web resulting from variations in said repeat length of said repetitive pattern in said length of web extending between said print detector and said web processing station.

6. The apparatus of claim 5, wherein said further registration means is a differential gear assembly and an electric motor, the one input of the differential gear assembly being connected to the web processing station, the other input being connected to said electric motor and the output being coupled to said encoder, rotation of said electric motor being controlled by said control unit in dependence upon said difference in phase between said print output signal and said operating output signal.

7. The apparatus of claim 5, wherein said further registration menas includes a variable phase shift circuit which is connected in series between said operating output of said encoder and said control unit and which generates a phase shift representing the difference in phase between said print output signal and said operating output signal.

* * * * *